United States Patent [19]

Talvensaari

[11] 4,398,850

[45] Aug. 16, 1983

[54] ROOF BOLTER AND PROCESS

[75] Inventor: Robert D. Talvensaari, White Pine, Mich.

[73] Assignee: Copper Range Company, Lakewood, Colo.

[21] Appl. No.: 232,884

[22] Filed: Feb. 9, 1981

[51] Int. Cl.[3] ..... E21D 20/02; E21C 5/00; E21C 9/00

[52] U.S. Cl. ..... 405/261; 405/303; 173/38; 173/43

[58] Field of Search ..... 405/259–261, 405/303; 173/38, 43; 175/209–211; 227/14

[56] References Cited

U.S. PATENT DOCUMENTS

| | | | |
|---|---|---|---|
| 2,646,256 | 7/1953 | Löbbert | 175/209 |
| 3,212,269 | 10/1965 | Olsen | 405/260 |
| 3,552,504 | 1/1971 | Chappuls | 175/52 |
| 4,105,081 | 8/1978 | Perraud | 175/122 |
| 4,215,953 | 8/1980 | Perraud | 405/303 |
| 4,229,124 | 10/1980 | Frey et al. | 405/303 |

FOREIGN PATENT DOCUMENTS

| | | | |
|---|---|---|---|
| 781361 | 11/1980 | U.S.S.R. | 405/303 |

*Primary Examiner*—David H. Corbin
*Assistant Examiner*—Nancy J. Pistel
*Attorney, Agent, or Firm*—Morse, Altman & Dacey

[57] ABSTRACT

Roof bolter and process for resin bolting a mine roof. The roof bolter comprises combined means for drilling and resin inserting in one position, means for bolt inserting in a second position, and means for positioning the roof bolter first into one and then into its second positions. The process comprises drilling a hole in the mine roof and inserting in tandem resin into the hole and, inserting into and securing a bolt within the hole. Preferably, the roof bolter and the process are automated and remotely controlled.

The invention further includes a device designed for attachment to a three-position resin type roof bolter and for converting it to a two-position resin type roof bolter.

14 Claims, 19 Drawing Figures

ROOF BOLTER AND PROCESS

BACKGROUND OF THE INVENTION

1. Field of the Invention

The present invention relates generally to roof bolters and, more particularly, to a two-position roof bolter and process for resin bolting a mine roof.

2. The Prior Art

Underground mining, whether for coal or ore, is an old art. There are two principal methods of underground mining: room-and-pillar and longwall working. Room-and-pillar mining denotes a system of mining in which the coal or ore is mined in rooms (i.e., tunnels) separated by pillars. Room-and-pillar mining is preferred when mining beneath surface building or under lakes and seas. The pillars are preferably left in position to minimize movement of the ground at the surface. When the pillars are left in place, the term "partial extraction" is applied to this system of mining. In room-and-pillar mining, once access to the seam has been gained, rooms (i.e., tunnels) are driven into the seam in two directions and at right angles to each other. As a result, the seam is divided into a number of rectangular blocks of coal or ore, which rectangular blocks are called pillars. In contrast, longwall working is a "total extraction" system of mining. In longwall working, all the coal or ore contained within a specified area is extracted in one operation. To do this, two parallel tunnels (also known as gate roads) are driven into the seam some 150 to 600 feet apart. The two parallel tunnels are then connected by a third tunnel formed at right angles to the two parallel tunnels. This third tunnel forms the longwall face. Successive strips are than taken off the side of the longwall face and the coal (or ore) is deposited on a face conveyor. The face conveyor in turn delivers the coal to the gate road conveyor and hence to the shaft. As the longwall face moves forward, the roof behind the face is allowed to collapse. The gate roads (the tunnels) however are being correspondingly advanced and of course supported. It is to the support of these tunnels, be they gate roads or rooms, that the invention pertains. For the drilling of the tunnels themselves, see U.S. Pat. No. 3,552,504 to L. L. Chappuis.

One of the more effective ways to support the tunnels is by inserting roof bolts in predrilled holes in the roofs of the tunnels. (A roof bolt is a long steel bolt anchored into walls or roofs of underground excavations to strengthen the pinning of rock strata.) The roof bolts are installed into the roofs at substantially evenly spaced intervals. The distance separating the bolts can vary from about two feet to about four feet, depending upon the degree of support required. Basically, there are two kinds of roof bolts, depending on how the bolts are anchored in the roof: a mechanically anchored roof bolt and a resin-anchored roof bolt. The mechanically anchored roof bolt is point anchored in the roof by the physical interaction between the expandable point anchor and the rock surrounding the anchor. This is fine until there is movement in the rock formation surrounding the bolt. If such movement in the rock surrounding the bolt is extensive, the bolt may give and weaken its support. In tunnels where long term support is required, resin-anchored bolts are preferred. The resin-anchored bolt is anchored in the resin introduced into the bolt hole ahead of the bolt. The resin, once set, forms a hard, solid, chemically formed bond with the rock formation surrounding the bolt and along the entire length of the bolt. Such a resin anchor is considerably stronger and longer lasting than merely mechanically anchored roof bolts.

Automated and remote controlled machines have been developed to perform roof bolting operations in mines. These roof bolting machines are very expensive. They are expensive because they have to be both efficient and safe deep down in a mine. Due to these requirements, these machines have become rather complex. Anything improving their efficiency or reducing their complexity without adversely affecting their safety pays rich and continuing dividends in mining operations.

A roofbolting operation essentially entails drilling a long, narrow, vertical hole into the mine roof and inserting and anchoring a bolt in the hole. For the mechanically anchored roof bolt, these two steps only are required. For the resin-anchored roof bolt a third, intermediate step—resin insertion—is also required. Roof bolting machines feature two-position turrets for roofbolting with mechanically anchored roof bolts, and they feature three-position turrets for roofbolting with resin-anchored roof bolts. If resin bolting is desired with only a two-position turret available, the resin then must be inserted into the drilled hole by some means other than by the turret. Often, this involves manual insertion. Manual insertion exposes the operator to risk, however. Representative three-position roof bolter apparatus are disclosed in U.S. Pat. Nos. 4,215,953 and 4,229,124 to R. J. Perraud and G. R. Frey et al, respectively.

The three-position turret is, on the other hand, a rather complex and expensive piece of equipment. For, in addition to providing a separate means for inserting the resin into the drilled hole, it requires other features in support of this resin insertion operation. These additional features include a reaming bit and a reaming motor, together with associated components. These are needed to drill a cone-shaped collar around the entrance of the hole. Such a cone-shaped collar is necessary to guide the resin injection nozzle into position with respect to the hole. See U.S. Pat. No. 4,105,081 to R. J. Perraud. The presence of these additional features on the turret, in turn, requires further and more complicated accessories in the automated remote control system for the turret. All this has a mushrooming effect, especially as regards costs—both initial costs of manufacture and, perhaps more significantly, operational and maintenance costs of such roofbolting equipment.

SUMMARY OF THE INVENTION

It is a principal object of the present invention to overcome the above shortcomings by providing a roof bolter and process for resin bolting a mine roof characterized by simplified construction and operation.

More specifically, it is an object of the present invention to provide a roof bolter comprising combined means for drilling and resin bolting with the roof bolter in one operative position, means for bolt inserting with the roof bolter in a second operative position, and means for positioning the roof bolter, first into this one and then into its second operative positions. Preferably, the roof bolter is automated and remotely controlled. The process essentially comprises drilling a hole in the mine roof and inserting in tandem, without repositioning the roof bolter, resin into the hole and, following positioning the roof bolter, inserting into and securing a roof bolt within the hole.

It is a further object of the present invention to provide a device designed for attachment to a three-position resin type roof bolter and for converting the same to a two-position resin type roof bolter.

Other objects of the present invention will in part be obvious and will in part appear hereinafter.

The invention accordingly comprises the automated, remote controlled, resin type roof bolting system and process of the present disclosure, its components, parts and their interrelationships, the scope of which will be indicated in the appended claims.

BRIEF DESCRIPTION OF THE DRAWINGS

For a fuller understanding of the nature and objects of the present invention, reference is to be made to the following detailed description, which is to be taken in connection with the accompanying drawings, wherein.

DETAILED DESCRIPTION OF THE PREFERRED EMBODIMENTS

Figure 1:
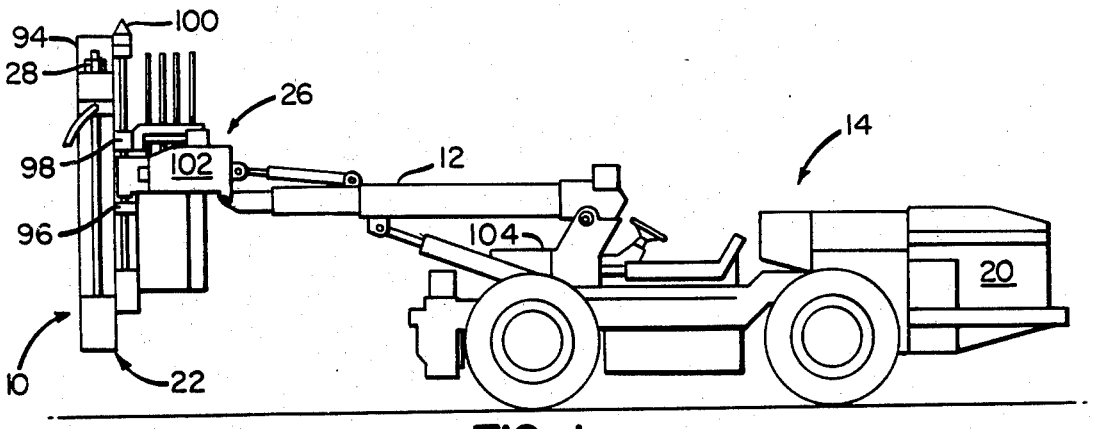
FIG. 1 is a side elevational view of a resin type roof bolter constructed in accordance with the invention and shown attached to a boom on a carrier.
Figure 3:
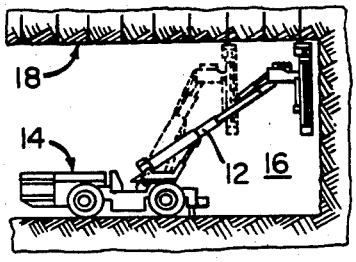
FIG. 3 is a side elevational view of the roof bolter of FIG. 1 in action in a mine tunnel.
Figure 4:
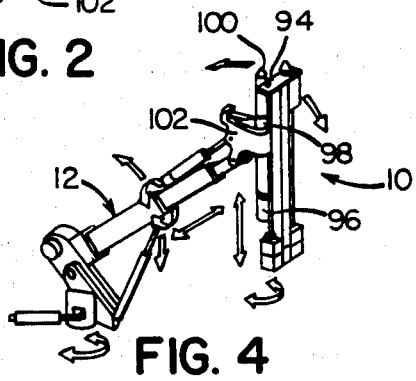
FIG. 4 is a perspective view of the roof bolter and the boom of FIG. 1, illustrating the several possible motions of each.

Generally, the illustrated embodiment of a resin type roof bolter 10 constructed in accordance with the invention is shown in FIG. 1, mounted on a bolter boom 12 of a carrier 14. The carrier 14 is completely self-contained and highly maneuverable. The carrier 14 has been designed to enter a freshly mined tunnel 16 whose roof 18 is intended to be reinforced by roofbolting, observe FIG. 3. The construction of the boom 12 and of the thereon mounted roof bolter 10 are such (note FIG. 4) that the roof bolter 10 can be made to operate on any exposed surface of the mine tunnel 16, not just the roof 18 thereof. The arrows shown in FIG. 4 indicate the several motions that each is capable of, whereby the roof bolter 10 can be aimed at any desired site within the tunnel.

Preferably, the carrier 14 is powered by a diesel engine 20. The diesel engine 20 in turn drives both a tramming hydraulic motor and a group of hydraulic pumps. The hydraulic motor provides the tramming to the carrier 14, and the group of hydraulic pumps respectively actuate the boom 12, the roof bolter 10 and the various operative parts of the roof bolter 10, as more fully described hereinafter.

The resin type roof bolter 10 (also known as a turret) essentially comprises combined means 22 for drilling and resin inserting in one position, means 24 for bolt inserting in another position, and means 26 for positioning the roof bolter 10, first into one and next into its second operative positions. The combined means 22 for drilling and resin inserting includes a device 28 having converging passages 30 and 32. One passage 30 is designed for drilling and the other passage 32 is designed for resin inserting. The device 28 comprises a housing block 34 preferably formed with an integral neck portion 36 and with angularly faced lower ends 38 and 40. Passage 30 is formed concentric with the neck portion 36, extends through the block 34 and exits in between the angularly faced lower ends 38 and 40. Passage 32 connects with the concentric passage 30 at an angle 42 —$\alpha$— and below the neck portion 36. Angle 42 ($\alpha$) is preferably about 30°. Housing block 34 can be provided further with a vent 44, whose significance will become apparent from a discussion of the operation of the roof bolter 10 to which it is attached.

A second preferred embodiment of a device 46 that forms part of the combined means 22 for drilling and resin inserting and employed for converting a three-position resin type roof bolter to a two-position resin type roof bolter is shown in FIGS. 11–14. Device 46 preferably comprises a housing block 48 and nozzles 50 and 51 mounted on the block 48. Preferably the nozzles 50 and 51 are formed with externally-threaded portions 52, 53 and hexagonal heads 54 and 55, respectively. The housing block 48 in turn is provided with tapped portions 56 and 57, meshing with portions 52, 53 of the nozzles 50 and 51. The threaded portions 52 and 53 preferably are formed with directions opposed to the rotation of the drilling means 22 lest the nozzles 50 and 51 work themselves loose during drilling. Preferably, the nozzles 50 and 51 are provided also with hard inner bushings 58 and 59, preferably extending along their axial lengths. Housing block 48 further is provided with a ring member 60 concentrically surrounding the nozzle 50. Ring member 60 is secured to the housing block 48, such as, for instance, by being welded thereto as at 62. In order to protect the nozzle 50 during drilling, the ring member 60 preferably extends from the housing block 48 a short distance beyond the nozzle 50.

Device 46, just like the device 28, is formed with converging passages 64 and 66 connecting with each other at an angle 68 —$\beta$— and below the nozzle 50. Preferably, angle 68 is also about 30°. Device 46 may also be provided with a vent communicating with passage 64. The passage 64 is concentric with the nozzles 50 and 51, extends through the housing block 48 and exits between angularly faced lower ends 72 and 74. The inside diameter of the passage 64 is somewhat smaller than the inside diameter of the hard, inner bushing 58. Passage 66, furthermore, is formed with an internal shoulder 76 and an enlarged portion 78 to facilitate the attachment thereto of a resin injection tube 80, without the need of a connecting member 82, as is the case with device 28, observe FIG. 10.

Figure 2:
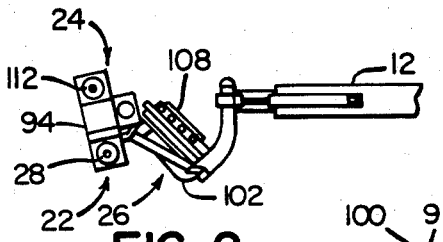
FIG. 2 is a plan view of the roof bolter of FIG. 1.
Figure 5:
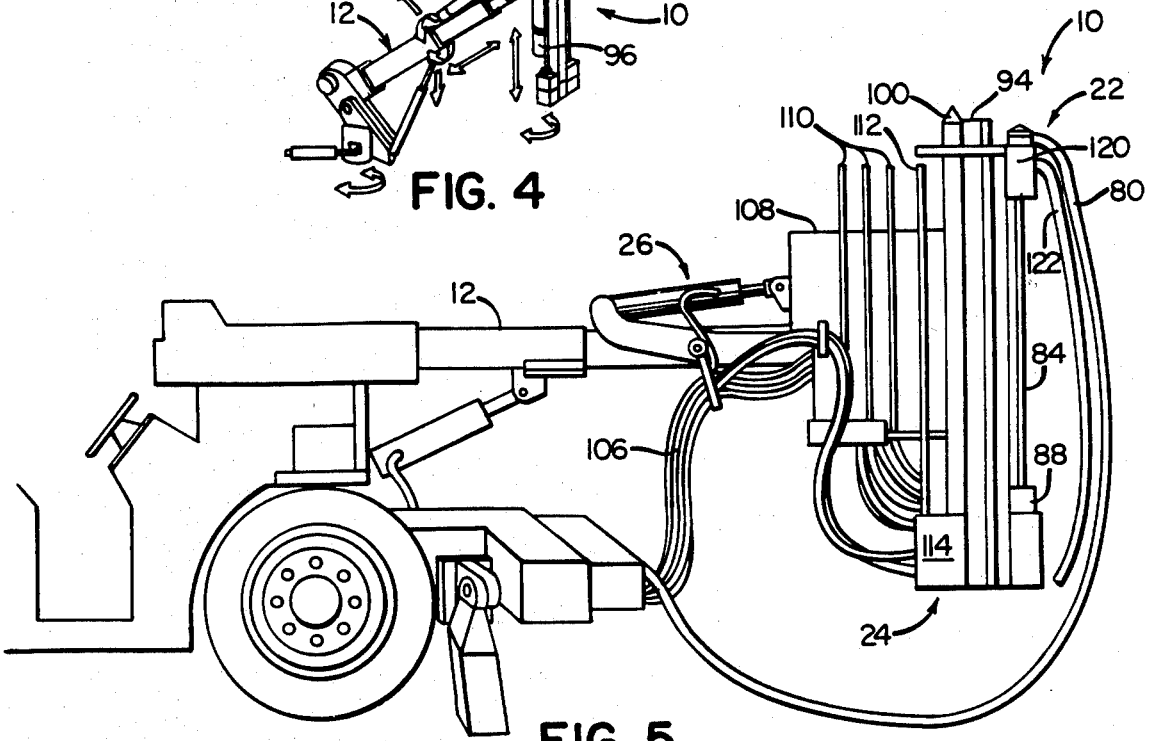
FIG. 5 is a perspective view of the roof bolter attached to the boom, also showing a magazine holding additional roof bolts.

The combined means 22 for drilling and resin inserting further includes a drill member 84 carrying a drill bit 86 at its front end. Drill member 84 is secured at its other end within a drilling motor 88 mounted via a suitable bracket 90 on a feed 92. Feed 92 is, in turn, secured to a roof bolter housing 94. Roof bolter housing 94 in turn is mounted via a pair of brackets 96 and 98 to an anchoring pin 100. Preferably, roof bolter housing 94 is so mounted to the anchoring pin 100 as to be axially displaceable about the pin 100. The anchoring pin 100 is secured within a member 102, which is mounted on the bolter boom 12. Preferably, the drill member 84 is hollowed along its axial length for water or air flushing with compressed air, as is known in mine drilling operations. Also, preferably, the roof bolter 10 is provided with means 104 for remote control operation of the roof bolter 10. Such means 104 is conveniently mounted on the carrier 14 within easy access of an operator. Means 104 is connected via suitable cables 106, carried by the boom 12, to the roof bolter 10. Preferably, the remote control operation of the roof bolter 10, as provided by the means 104, is automated. Also, preferably, a bolt magazine 108 is provided adjacent the member 102 and secured thereto. The bolt magazine 108 is designed to contain a plurality of additional bolts 110 (three being shown in FIG. 5) to provide the roof bolter 10 with a capacity for continuous, automated operation in roofbolting a larger segment of the mine roof 18 than is possible without the magazine 108. Once the magazine 108 is manually loaded with the additional bolts 110, it has automatic feed means to advance the bolts 110, seriatim, and to replace a further bolt 112 ready for insertion. This bolt 12 is, of course, secured within the bolt inserting means 24 that includes a wrench 114. Wrench 114 is designed both to rotate the bolt 112 positioned therein and to advance the rotating bolt 112 during bolt insertion. Bolt inserting means 24 is secured to the roof bolter housing 94 at a position opposed to that of the combined means 22 for drilling and resin inserting, as may be best observed in FIG. 2.

OPERATION

Figure 6:
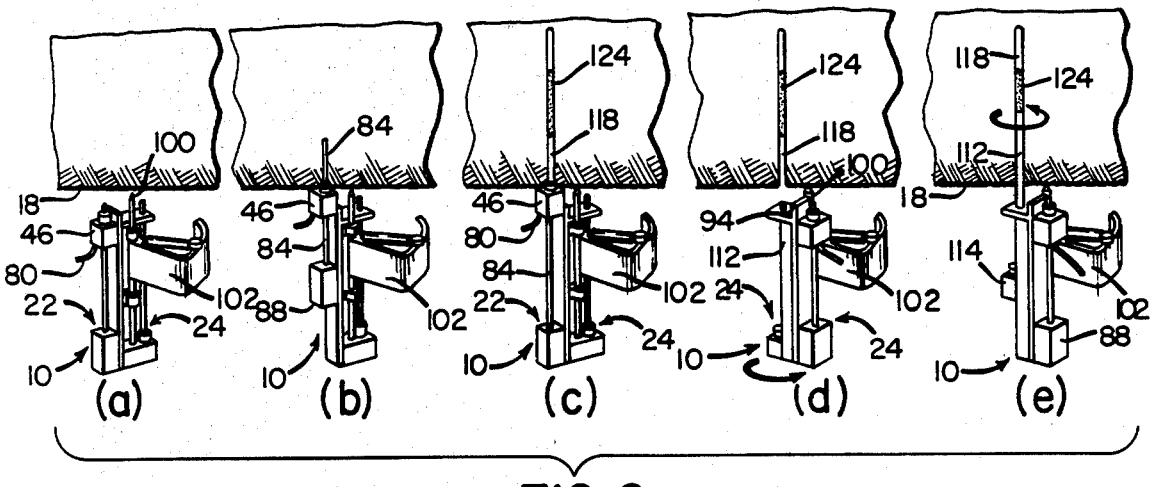
FIGS. 6 (*a*)-(*e*) depict the roof bolter in action.
Figure 11:
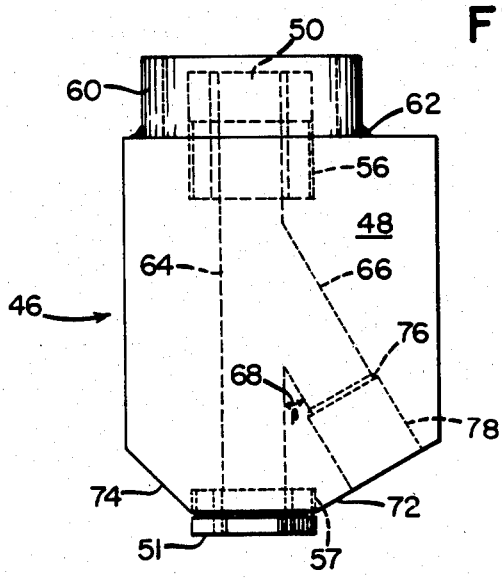
FIG. 11 is a view similar to that of FIG. 8 but showing a different embodiment of a device for converting a three-position resin type roof bolter to a two-position resin type roof bolter.
Figure 12:
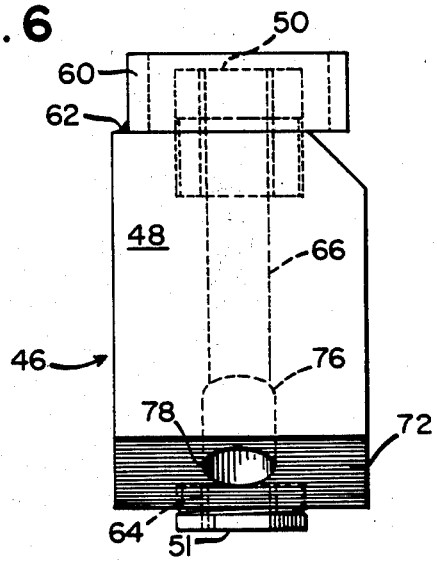
FIG. 12 is a front elevational view of the device of FIG. 11.
Figure 13:
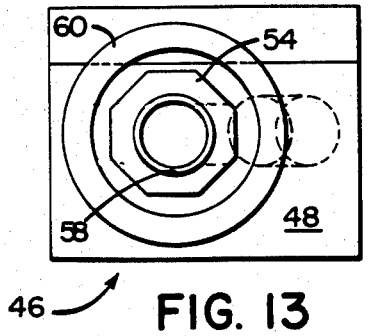
FIG. 13 is a plan view of the device of FIG. 11.
Figure 14:
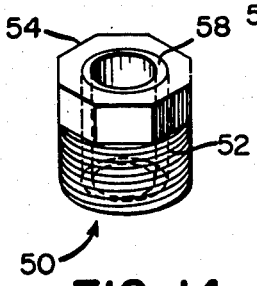
FIGS. 14 and 15 are perspective views of removable component parts of the device of FIG. 11.
Figure 15:
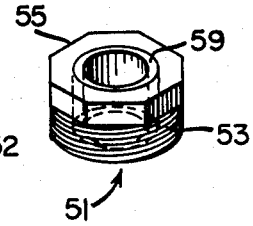
Figure 7:
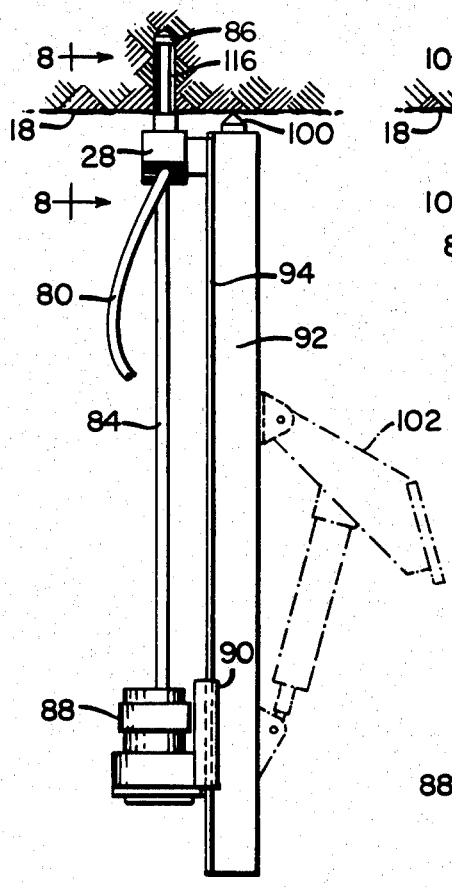
FIG. 7 shows a roof bolter, with parts omitted for clarity, in the drilling mode.
Figure 9:
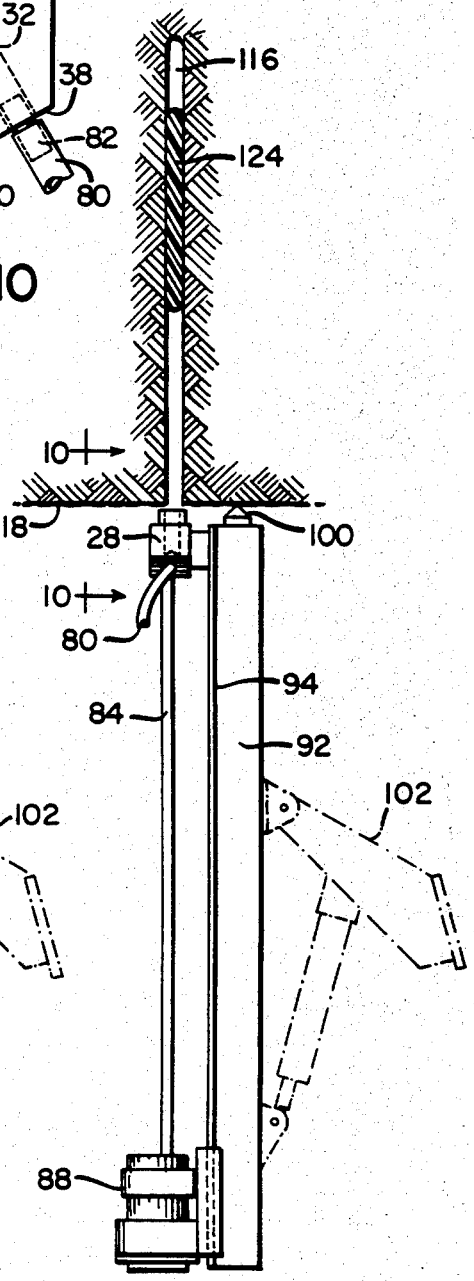
FIG. 9 is a view similar to that of FIG. 7 but showing the roof bolter in the resin injection mode.

The process for resin bolting the roof 18 of a mine tunnel 16 with the two-position roof bolter 10 of the invention is illustrated in FIGS. 6, 7 and 9. FIG. 6 depicts the roof bolter 10 in action after the carrier 14 has been positioned into appropriate roofbolting position with respect to a segment of the roof 18 in the tunnel 16.

After loading the bolt magazine 108 with the bolts 110 and placing the bolt 112 into the wrench 114, the operator moves the roof bolter 10 into operative position with respect to the roof 18 by movements of the bolter boom 12. This he accomplishes by manipulating the controls at the remote control means 104. When the operator is satisfied that the site selected in the roof 18 is the desired one for roofbolting, he causes the roof bolter 10 to be anchored in place against the roof 18 by firmly lodging the anchoring pin 100 thereagainst, as shown in FIG. 6(*a*). The anchoring pin 100 of the roof bolter 10 remains in this position during the entire roofbolting operation. The roof bolter housing 94 is still in its lowermost position away from the roof 18 and the roof bolter 10 is in its drilling and resin inserting first operative position.

Figure 8:
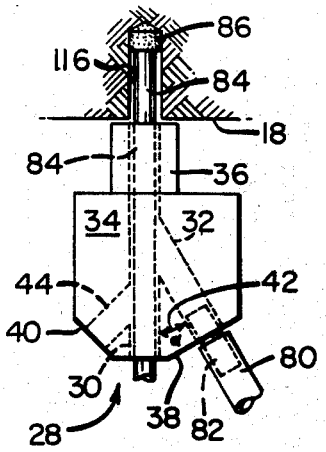
FIG. 8 is a side elevational view, on an enlarged scale, of a device, designed for converting a three-position resin type roof bolter to a two-position resin type roof bolter, and taken along the lines 8—8 of FIG. 7.

Just prior to drilling and resin inserting, the roof bolter housing 94 is caused to advance axially about the anchoring pin 100 toward the roof 18 until either the neck portion 36 of the device 28 (FIG. 7) or the ring member 60 of the device 46 (FIG. 6(*b*)) (depending which device has been attached to the roof bolter 10) comes to rest against the roof 18. Now the roof bolter is ready to commence drilling a hole 116 (in FIG. 7, or 118 in FIG. 6) in the mine roof 18. Drilling of the hole 116 (or 118) is accomplished by rotating the drill member 84 and axially advancing it through one 30 of the converging passages of the device 28 (or through passage 64 in the device 46), as may be best observed in FIG. 8. During drillings, water or air under pressure is continuously admitted through the axial hollow of the drill member 84 to the drill bit 86 for continuously flushing the hole 116. A water and cuttings collector 120 (or if air is used, simply a cuttings collector) is mounted just below the combined means 22 for drilling and resin inserting, observe FIG. 5. A hose 122 connected to the collector 120 drains the water and/or the cuttings to the mine floor, protecting thereby the roof bolter 10 from extra unnecessary wear. A further hose (not shown) can be connected to the vent 44 (FIGS. 8 and 9) to keep the device 28 clean during drilling.

Figure 10:
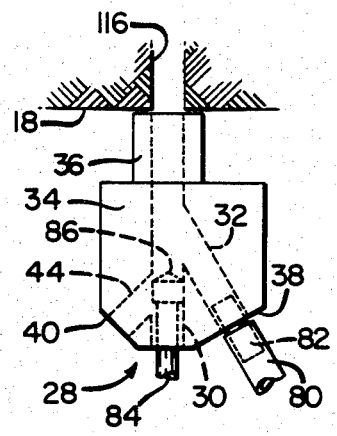
FIG. 10 is a view similar to that of FIG. 8 but showing the device in the resin injection mode and taken along the lines 10—10 of FIG. 9.

Upon completion of the drilling operation, the drill member 84 is withdrawn from the just drilled hole 116 to the position shown in FIG. 10. As can be observed in FIG. 10, the drill bit 86 leaves vent 44 partially uncovered. It should be noted, however, that the combined means 22 for drilling and resin inserting, including either the device 28 or the device 46, remains in fixed position against the mine roof 18 after the completion of the drilling operation and during the resin insertion.

In resin bolting, the resin is typically introduced into the hole 116 contained within an appropriately shaped, flexible cartride 124. The cartride 124 is preferably formed of a resilient, deformable material that is susceptible to being broken. The cartride 124 is designed to be injected under pressure into the hole 116 via the pneumatic tube 80. See U.S. Pat. No. 4,215,953, supra, for a resin cartride injection device. Any excess air under pressure is allowed to escape through the partially uncovered vent 44. Since the device 28 (or the device 46) has remained in a fixed place during both the drilling and the resin inserting operations, the heretofore existing need for reaming a bevel at the entry of the hole 116 has been eliminated. This cone-shaped bevel is required with prior-art three-position roof bolters to allow some degree of flexibility for a separate resin injection nozzle to locate and become aligned with the hole 116. For, in case of misalignment, the resin cartridge 124 is apt to break at the entry to the hole 116. The spilled resin flowing from the ruptured cartridge 124 not only makes roofbolting of that particular hole 116 unlikely but it renders further roofbolting impossible until after the roof bolter has first been thoroughly cleaned and the remnants of the spilled resin removed therefrom. Thus, the roof bolter 10 of the invention eliminates the need for a hydraulic reaming motor to drive a reaming bit for reaming a bevel at the entry of the hole 116. It also eliminates the need for a separate resin injection nozzle and associated components to introduce that nozzle into the hole 116.

Preferably, the resin cartridge 124 is injected about two-thirds up into the drilled hole 116, observe FIG. 9 (or within hole 118 in FIG. 6(*c*)). This position for the cartridge 124 within the hole 116 is advantageous for optimum bolt insertion and bolt setting following pivoting the two-position roof bolter 10 into its second operative position.

Following the injection of the resin cartridge 124 into the hole 116 (or hole 118 in FIG. 6), the roof bolter housing 94 is retracted axially about the anchoring pin 100 away from contact with the mine roof 18, with only the pin 100 remaining anchored against the roof 18. This retraction for the housing 94 is required to enable the roof bolter 10 to be pivoted into its second operative position, namely that of bolt inserting, as shown in FIG. 6(*d*). This pivoting of the roof bolter 10 is accomplished by the positioning means 26 described particularly with reference to FIGS. 1 and 2. Essentially, this positioning means 26 includes appropriate arms secured to the bolter boom 12 and manipulated remotely by an operator via the control means 104 mounted on the carrier 14. With the bolt inserting means 24 in position following pivoting, the bolt 112 is now ready for insertion into the hole 118. Bolt insertion commences after the roof bolter 10 has been once again advanced axially about the anchoring pin 100 until it comes to rest against the roof 18 of the mine tunnel 16. Thereupon, the wrench 114 causes the bolt 112 both to revolve and to advance into the hole 118. Preferably, the wrench 114 revolves at about 600 r.p.m. during bolt insertion. When the bolt 112 reaches the resin cartridge 124 previously injected into the hole 118, it ruptures the same. The still advancing and rotating bolt 112 first thoroughly mixes the spilled resin from the cartridge 124 along the axial length of the bolt 112 during the time that the bolt 112 completes its full penetration of the hole 118. Once the bolt 112 achieves its full penetration, its continued revolution creates a temperature increase in the resin within the hole 118 that allows for quick setting of the resin about the now inserted bolt 112 almost immediately after its rotation by the wrench 114 ceases. Upon the setting of the resin about the inserted bolt 112, the wrench 114 is allowed to release the bolt 112. Then, the roof bolter 10 first is axially retracted about the anchoring pin 100 from its contacting position with the mine roof 18. Second, the bolter boom 12 is caused to lower away the roof bolter 10 from its anchored position via the pin 100 against the roof 18. The process cycle is now complete. The bolter boom 12 is now caused to move the roof bolter 10 into a new roofbolting position with respect to the roof 18 so as to commence the next resin bolting operation. With three additional bolts 110 in the bolt magazine 108, four bolts can be installed in the roof 18 before a manual reloading of the magazine 108 and of the roof bolter 10 is again required.

Thus it has been shown and described a two-position resin type roof bolter 10 designed for the resin bolting of mine roofs, which roof bolter 10 satisfies the objects and advantages set forth above.

Since certain changes may be made in the present disclosure without departing from the scope of the present invention, it is intended that all matter described in the foregoing specification or shown in the accompanying drawings, be interpreted in an illustrative and not in a limiting sense.

What is claimed is:

1. A two-position resin type roof bolter with a single indexing between said two positions comprising:

(a) combined means for drilling and resin inserting in one position of said roof bolter without indexing between said drilling and said resin inserting;

(b) means for bolt inserting in a second position of said roof bolter after said single indexing thereof; and (c) means for positioning said roof bolter, first into said one and then into its said second positions.

2. The two-position resin type roof bolter of claim 1 wherein said combined means includes a device having two converging passages: a drilling passage and a resin injection passage.

3. The two-position resin type roof bolter of claim 2 wherein said device comprises a housing block and at least one nozzle mounted on said block, said drilling passage being concentric with said nozzle, said resin injection passage connecting with said drilling passage at an angle and below said nozzle.

4. The two-position resin type roof bolter of claim 3 wherein said nozzle is provided with an inner bushing having an inside diameter somewhat larger than the inside diameter of said resin injection passage, and wherein said housing is formed with a tapped portion and said nozzle is formed with an externally threaded portion meshing with said tapped portion, whereby said nozzle is removably mounted to said housing.

5. The two-position resin type roof bolter of claim 3 wherein said angle of connection between said converging passages is about 30°.

6. The two-position resin type roof bolter of claim 3 wherein said housing block is further provided with a vent radially communicating with said drilling passage at a point below the confluence of said two converging passages.

7. The two-position resin type roof bolter of claim 4 wherein said resin inserting passage is formed with an internal shoulder to facilitate the attachment thereto of a pneumatic hose to introduce a resin cartridge into said resin inserting passage.

8. The two-position resin type roof bolter of claim 3 wherein said housing block is further provided with a protective solid ring member concentrically surrounding said nozzle and extending from said housing block beyond said nozzle.

9. The two-position resin type roof bolter of claim 1 further including a boom supporting said roof bolter at one end and communicating with means at its other end for providing remote control operation to said roof bolter.

10. The two-position resin type roof bolter of claim 9 wherein said means providing remote control operation to said roof bolter is automated.

11. A process for resin bolting a mine roof comprising:

(a) positioning a turret into a drilling position with respect to said mine roof;

(b) drilling a hole with said turret in said mine roof;

(c) without re-positioning said turrent, inserting a resin cartridge with said turret into said hole; and (d) positioning said turret into a bolt inserting position with respect to said hole and inserting a bolt with said turret into said hole.

12. The process of claim 11 wherein said process is a fluid actuated process.

13. The process of claim 11 wherein said process is remotely controlled.

14. The process of claim 11 wherein said process is automated.

* * * * *